US012693069B2

(12) United States Patent
Engstler et al.

(10) Patent No.: US 12,693,069 B2
(45) Date of Patent: Jul. 28, 2026

(54) METHOD AND SYSTEM FOR CONTROLLING A STORAGE ATMOSPHERE FOR A STORAGE ITEM

(71) Applicant: BSH Hausgeräte GmbH, Munich (DE)

(72) Inventors: Antje Engstler, Heidenheim (DE); Niels Liengaard, Ulm (DE); Delia Rademacher, Wipperfürth (DE); Carsten Weiss, Giengen (DE)

(73) Assignee: BSH Hausgeräte GmbH, Munich (DE)

( * ) Notice: Subject to any disclaimer, the term of this patent is extended or adjusted under 35 U.S.C. 154(b) by 179 days.

(21) Appl. No.: 18/549,965

(22) PCT Filed: Mar. 1, 2022

(86) PCT No.: PCT/EP2022/055103

§ 371 (c)(1),
(2) Date: Sep. 11, 2023

(87) PCT Pub. No.: WO2022/189207

PCT Pub. Date: Sep. 15, 2022

(65) Prior Publication Data

US 2024/0151463 A1 May 9, 2024

(30) Foreign Application Priority Data

Mar. 9, 2021 (DE) ..... 10 2021 202 247.2

(51) Int. Cl.
*F25D 29/00* (2006.01)

(52) U.S. Cl.
CPC ..... *F25D 29/00* (2013.01); *F25D 2500/06* (2013.01); *F25D 2700/06* (2013.01); *F25D 2700/12* (2013.01)

(58) Field of Classification Search
CPC .. F25D 29/00; F25D 2500/06; F25D 2700/06; F25D 2700/12
See application file for complete search history.

(56) References Cited

U.S. PATENT DOCUMENTS

| | | | |
|---|---|---|---|
| 7,401,469 B2 | 7/2008 | Joshi et al. | |
| 10,330,377 B2 | 6/2019 | Klingshirn | |
| 2017/0205138 A1 | 7/2017 | Hwang et al. | |
| 2019/0186817 A1* | 6/2019 | Hwang | F25D 11/02 |
| 2022/0057121 A1 | 2/2022 | Jeong et al. | |

FOREIGN PATENT DOCUMENTS

| | | |
|---|---|---|
| CN | 107144086 A | 9/2017 |
| DE | 102013211097 A1 | 12/2014 |
| DE | 102016220305 A1 | 4/2018 |
| KR | 1020200068832 A | 6/2020 |

* cited by examiner

*Primary Examiner* — Jonathan Bradford
(74) *Attorney, Agent, or Firm* — Laurence A. Greenberg; Werner H. Stemer; Ralph E. Locher

(57) ABSTRACT

A method for operating a household refrigeration appliance includes detection of a storage item to be disposed and/or is disposed in a refrigeration compartment of the appliance. An acceptance storage atmosphere is determined. The storage atmosphere differs from a target storage atmosphere to the storage item in the refrigeration compartment and in which storage of the storage item is acceptable based on the storage item.

13 Claims, 2 Drawing Sheets

METHOD AND SYSTEM FOR CONTROLLING A STORAGE ATMOSPHERE FOR A STORAGE ITEM

FIELD AND BACKGROUND OF THE INVENTION

The invention relates to a method for operating a household refrigeration appliance according to the preamble of the independent method claim, a household refrigeration appliance according to the independent household refrigeration appliance claim and a household system according to the independent household system claim.

A method for determining the remaining shelf life of an item to be refrigerated in a storage chamber of a refrigeration appliance is already known from the prior art. In addition, a camera module has been proposed, for example, in the published patent application DE 10 2013 211 097 A1 for detecting image data of an item to be refrigerated at a first time and at a second time, wherein a freshness determination facility for determining a state of freshness of the item to be refrigerated is implemented on the basis of the image data.

SUMMARY OF THE INVENTION

The object of the invention, in particular, is to provide a generic method and/or a generic appliance having improved properties in terms of convenience. The object is achieved according to the invention by the features of the independent claims while advantageous embodiments and developments of the invention can be found in the dependent claims.

The invention is based on a method for operating a household refrigeration appliance, in particular a household refrigeration appliance operating method, wherein a storage item which is to be arranged and/or is arranged in a refrigeration compartment of the household refrigeration appliance is detected in a detection step and, in particular, a target storage atmosphere for storing the storage item in the refrigeration compartment is determined in a determination step.

It is proposed that an acceptance storage atmosphere which differs from the target storage atmosphere for storing the storage item in the refrigeration compartment and in which storage of the storage item is still and/or already acceptable is determined in a determination step based on the storage item.

A convenience, relative to a user convenience, can be improved by means of such an embodiment. In particular, a user can be provided with an advantageously safe storage of a storage item, for example relative to a shelf life of the storage item. In addition, a determination routine can be optimized relative to a storage of the storage item and a user-friendly method for operating a household refrigeration appliance and/or a user-friendly household refrigeration appliance can be provided by determining an acceptance storage atmosphere which differs from a target storage atmosphere, as a function of the storage item, wherein in particular a loss of quality and/or damage to health can be averted. Moreover, a waiting time relative to an adaptation of a storage atmosphere in a refrigeration compartment can potentially be shortened for the user, since when the acceptance storage atmosphere is present the storage item can already be introduced into the refrigeration compartment, in particular without damage. Thus it is possible to dispense with waiting until the target storage atmosphere is reached in the refrigeration compartment. Moreover, due to a larger acceptance range for storing a storage item, notification messages to the user can be reduced so that potentially a warning message which differs, for example, from a status message relative to the storage atmosphere is output to the user only when the user is to be made aware of a real danger relative to the storage of the storage item.

In the present case, a method is provided by which a storage corresponding to the storage item, in particular a storage atmosphere corresponding to the storage item, in the refrigeration compartment is determined as a function of the detected storage item. Preferably, the storage corresponding to the storage item, in particular the storage atmosphere corresponding to the storage item, is a storage, in particular a storage atmosphere, which should be advantageously provided for the detected storage item for storing the storage item in the refrigeration compartment. The method for operating the household refrigeration appliance could consist of a plurality of method sub-steps. In particular, the detection step describes a first method sub-step of the method. Relative to a time progression of the method, the determination step could be a second method sub-step of the method following the detection step, in particular after the first method sub-step.

The household refrigeration appliance is preferably part of a household system. The household system is provided for use in a household and/or for use with household objects, wherein the household system in particular comprises at least one, advantageously at least partially electronic, item of household furniture, such as for example a food storage unit, and/or a spice rack, and/or at least one household appliance and preferably at least the household refrigeration appliance, such as for example a refrigerator, a freezer, an upright freezer, a chest freezer, a fridge-freezer and/or a wine cooler. Particularly preferably, the household refrigeration appliance has at least the refrigeration compartment for storing the storage item. The storage item is configured, in particular, as any storage item which is preferably arranged and/or is to be arranged in the household refrigeration appliance, in particular as consumer products and/or advantageously as consumables, preferably as food. Alternatively, the storage item could also be at least one cosmetic and/or medical item. The storage item could comprise exactly one storage item element, such as for example a single bottle or a lettuce and/or a plurality of storage item elements, such as for example a plurality of eggs or a plurality of apples. In the last case, the storage item could comprise, for example, a multipack and/or an egg box and/or a bag of apples. It might also be conceivable that the household system comprises the storage item.

In at least one operating state of the household refrigeration appliance, the storage item which is to be arranged and/or is arranged in the refrigeration compartment of the household refrigeration appliance could be detectable. Advantageously, the household refrigeration appliance and/or the household system has a detection unit. The storage item could be detected in the detection step by means of the detection unit. The detection unit is preferably a unit which is operatively connected to the household refrigeration appliance and is advantageously at least partially, preferably at least to a large extent and particularly preferably entirely arranged inside the household refrigeration appliance and/or integrated in the household refrigeration appliance, and which is provided, in particular, at least for detecting the at least one storage item and advantageously for detecting a plurality of storage items, in particular separately and/or advantageously simultaneously. The expression "to a large extent" is intended to be understood to mean, for example, at least 55%, advantageously at least 65%, preferably at least 75%, particularly preferably at least 85% and particularly advantageously at most 95% of a volume fraction and/or mass fraction.

At least one object color, object structure and/or object geometry of the storage item could be detected in the detection step. Moreover, advantageously a position and/or location and/or orientation of the storage item, in particular in the refrigeration compartment, could be detected in the detection step. The detection unit could have at least one, preferably mechanical, capacitive, resistive, haptic, electrical, electromagnetic, acoustic and/or preferably optical detection element which could comprise a passive and/or active sensor. It might be conceivable that in the detection step a user manually selects and/or inputs the storage item and/or inputs it by speech, in particular by means of the detection unit. Preferably, the detection element has a laser scanner, in particular a code scanner, an IR sensor and/or a CCD sensor and/or advantageously a camera. Preferably, the detection unit provides a detection signal which is correlated with the, in particular detected, storage item and which is used, in particular, in the determination step for determining the target storage atmosphere and/or the acceptance storage atmosphere. In particular, the target storage atmosphere and/or the acceptance storage atmosphere is determined after the storage item has been detected.

The household system and/or the household refrigeration appliance could have a computing unit which is provided to determine in the determination step on the basis of the storage item at least the acceptance storage atmosphere which differs from the target storage atmosphere for storing the storage item in the refrigeration compartment. Additionally, the computing unit preferably determines the target storage atmosphere in the determination step, in particular on the basis of the determined storage item. The computing unit is, in particular, an electrical and/or electronic unit which advantageously has an information input, an information processing system and an information output. Advantageously, the computing unit also has at least one processor, at least one memory, at least one input and/or output means, at least one operating program, at least one regulating routine, at least one control routine and/or at least one calculating routine. The computing unit could be part of a server network and/or cloud network and, in particular, could be incorporated in the internet. Advantageously, however, the computing unit is integrated in the household refrigeration appliance and/or a further item of household furniture and/or a further household appliance of the household refrigeration appliance.

In the determination step, the computing unit could access a database of the household system and/or the household refrigeration appliance. The database could be, for example, a cloud, local and/or region-specific database, which advantageously could be extended, updated and/or adapted by means of a network unit as required. The acceptance storage atmosphere and/or the target storage atmosphere could be predefined. The database could comprise at least one memory unit and advantageously could be provided to store a plurality of predefined acceptance and/or target storage atmospheres, such as for example at least 50 predefined acceptance and/or target storage atmospheres, at least 100 predefined acceptance and/or target storage atmospheres and/or at least 500 predefined acceptance and/or target storage atmospheres, relative to storage items, in particular storage items of different types, in particular consistently and advantageously permanently. A storage item of a first type could correspond, for example, to a tomato, while a storage item of a second type could correspond, for example, to an egg. The predefined acceptance and/or target storage atmosphere could already be applied, established and/or determined in a manufacturing process, a set-up process and/or an initializing process, in particular of the database and/or the household system, and in particular stored in the database.

The storage atmosphere of the refrigeration compartment could be defined by means of at least one parameter, such as for example by a temperature and/or a relative air humidity and/or an irradiation parameter and/or an air composition in the refrigeration compartment. Preferably, the acceptance storage atmosphere is a storage atmosphere of the refrigeration compartment in which the storage, in particular an at least substantially damage-free storage, is still and/or already acceptable, for example relative to a storage orientation, for example vertical and/or horizontal, a shelf life and/or a freshness parameter of the storage item. The storage item could be already introduced and/or arranged in the refrigeration compartment, for example, at an acceptance temperature of 3° C., wherein a target temperature could be, for example, 7° C. Alternatively or additionally, the storage item could even be introduced and/or arranged in the refrigeration compartment at an acceptance temperature of, for example, 1° C., wherein the target temperature could possibly be −3° C. The acceptance storage atmosphere could differ from the target storage atmosphere, in particular the target temperature and/or a target air humidity, for example, by at most 60%, advantageously by at most 50%, preferably by at most 30%, in particular by at least 1%, advantageously by at least 15% and by at least 10% relative to a value and/or the parameter, in particular the acceptance temperature and/or an acceptance air humidity. It might be conceivable that the acceptance storage atmosphere differs from the target storage atmosphere, for example, by at least 3° C., advantageously at least 5° C., preferably at least 10° C. and in particular by at most 20° C. A temperature in the refrigeration compartment could possibly be adapted in a range from at most 20° C., advantageously at most 18° C., preferably at most 10° C. to at most −10° C., preferably at most −18° C., particularly preferably at most −20° C. A relative air humidity in the refrigeration compartment could possibly be adapted in a range from at least 10%, advantageously at least 20%, preferably at least 30% to at most 60%, preferably at most 80%, particularly preferably at most 95%.

In the present document numerical terms such as, for example, "first" and "second" which are placed before certain terms merely serve for differentiating method steps and/or objects and/or an assignment of objects to one another, and do not imply an existing total number and/or ranking of the objects and/or method steps. In particular, a "second" object and/or method step does not necessarily imply a presence of a "first" object and/or method step. "Provided" is intended to be understood to mean here and hereinafter as specifically programmed, designed and/or equipped. An object being provided for a specific function is to be understood to mean that the object fulfills and/or executes this specific function in at least one use state and/or operating state.

It is further proposed that an actual storage atmosphere in the refrigeration compartment is verified and compared with the determined acceptance storage atmosphere in a verification step. As a result, a convenience can be further improved and namely by a current actual storage atmosphere of the refrigeration compartment being able to be taken into consideration and thus a determination routine being able to be designed to be more efficient. In particular, relative to the time progression of the method, the verification step takes place after the determination step. In the verification step the computing unit could compare the actual storage atmosphere with the determined acceptance storage atmosphere. It might be conceivable that an actual temperature and/or an actual air humidity is compared with the acceptance temperature and/or the acceptance air humidity in the verification step. The detection unit is possibly provided for verifying the actual storage atmosphere in the refrigeration compartment, for example by means of a temperature sensor and/or air humidity sensor.

It might be conceivable that the actual storage atmosphere corresponds to the acceptance and/or target storage atmosphere. If the actual storage atmosphere deviates from the acceptance storage atmosphere, it is proposed that the actual storage atmosphere is changed in the direction of the acceptance storage atmosphere in an adaptation step. As a result, a user convenience can be further improved, since an actual storage atmosphere of a refrigeration compartment can be adapted to an acceptance storage atmosphere corresponding to the storage item, specifically as a function of a detected storage item which can be arranged in the refrigeration compartment. Additionally, by means of the adaptation the storage item is advantageously able to be stored without damage, for example relative to a shelf life. In particular, relative to the time progression of the method, the adaptation step takes place after the verification step. Preferably, the household refrigeration appliance has a control unit for controlling an operation of the household refrigeration appliance. The computing unit could be part of the control unit. The control unit could be provided at least to change the actual storage atmosphere in the direction of the acceptance storage atmosphere in the adaptation step. In particular, the actual storage atmosphere of the refrigeration compartment is adapted to the acceptance storage atmosphere in the adaptation step. Relative to a time period, the acceptance storage atmosphere is reached at an acceptance time in the adaptation step.

Relative to an energy-saving mode of the household refrigeration appliance and/or the household system, the actual storage atmosphere could be simply adapted to the acceptance storage atmosphere. In this case, the acceptance storage atmosphere could be the target storage atmosphere and the actual storage atmosphere of the refrigeration compartment could be simply adapted in the direction of the acceptance storage atmosphere. It is further proposed, however, that if the actual storage atmosphere deviates from the target storage atmosphere, the actual storage atmosphere is changed to the target storage atmosphere in the adaptation step. As a result, a convenience, in particular a user convenience, can be improved even further, since for storing a storage item not only an acceptance storage atmosphere but also a target storage atmosphere can be provided in a refrigeration compartment as a function of the detected storage item. Relative to the time period, the target storage atmosphere is reached at a target time in the adaptation step. Preferably, the target time is after the acceptance time in the time period, so that the acceptance time is reached before the target time in the adaptation step.

In order to provide an advantageously intelligent and user-friendly method and/or household refrigeration appliance, it is proposed that at least one output is generated as a function of the detected storage item relative to the acceptance storage atmosphere of the storage item. The household system and/or the household refrigeration appliance could be an output unit, for example a display, for the optical and/or acoustic output of at least one piece of information, in particular changing information, relative to the acceptance storage atmosphere of the storage item, in particular to the user. The output unit could comprise at least one output element, wherein at least the output element is advantageously arranged on an outer face of a housing of the household refrigeration appliance, in particular on an outer face of a household refrigeration appliance door of the household refrigeration appliance. Alternatively and/or additionally, the refrigeration compartment could comprise the output element and/or at least one further output element of the output unit for the output of information relative to the acceptance storage atmosphere of the storage item.

Alternatively and/or additionally for improving a user convenience, in particular relative to a flexibility, it is proposed that the output is generated on a mobile terminal device. The mobile terminal device could be, for example, a multimedia unit provided for entertainment purposes for the user. Advantageously, the mobile terminal device is, for example, a cell phone and/or a tablet and/or a phablet and/or a personal digital assistant (PDA) and/or a laptop. In particular, the multimedia unit is a unit which is designed to provide information and/or contents from digital media, in particular apps.

Preferably, the output comprises a status message which is output in the adaptation step relative to the acceptance storage atmosphere being reached. Thus a convenience can be provided relative to the display of a status, in particular a permanent output, relative to an acceptance storage atmosphere being reached in a refrigeration compartment of the household refrigeration appliance. The status message could be displayed, for example, by means of a progress bar and/or a traffic light system, in particular a red-green traffic light or a red-yellow-green traffic light. In the case of the traffic light system, for example, at least two different colors, for example red, yellow and/or green could be output in the adaptation step relative to the acceptance storage atmosphere being reached. Advantageously, the output displays the status of the storage atmosphere in the refrigeration compartment, in particular relative to the actual storage atmosphere, the acceptance storage atmosphere and/or the target storage atmosphere.

If the status message comprises a storage request, a user can be notified in an efficient and convenient manner when a storage item can be stored in the refrigeration compartment, in particular without impairing, for example, a shelf life. In the case of the traffic light system, the storage request is advantageously displayed on the basis of a green and/or yellow color. In particular, when the acceptance storage atmosphere is reached at the acceptance time and/or the target storage atmosphere is reached at the target time, the storage request is output so that the user is advantageously prompted to store the storage item and/or the user is made aware of a time for storing the storage item in the refrigeration compartment without damage. For example, the refrigeration compartment could be advantageously transferred in the adaptation step from a freezer mode with an actual temperature of −10° C. to a refrigerating mode, in particular at the target temperature of 3° C., wherein the storage request is displayed to the user as a function of the storage item when the acceptance storage atmosphere is reached, for example at an acceptance temperature of 1° C.

It is further proposed that the output comprises a warning message which is output in the adaptation step relative to an absence of the acceptance storage atmosphere. Thus a user can be advantageously warned before storing a storage item if an actual storage atmosphere of a refrigeration compartment of the household refrigeration appliance it not yet adapted to the acceptance storage atmosphere, in particular if the acceptance storage atmosphere is not present in the refrigeration compartment. The warning message is output if the actual storage atmosphere deviates from the acceptance storage atmosphere, in particular the target storage atmosphere. In the case of the traffic light system, the output could output, for example, a yellow and/or red color and preferably make the user aware of the absence of the acceptance storage atmosphere. In particular, the warning message is output before the acceptance time is reached, wherein in particular the actual storage atmosphere differs from the acceptance storage atmosphere before the acceptance time. It might also be conceivable that the warning message is output relative to a storage item which is already located in the refrigeration compartment and the user is preferably prompted to remove the storage item from the refrigeration compartment, in particular until the actual storage atmosphere in the refrigeration compartment is adapted to the acceptance storage atmosphere.

In order to improve a convenience even further and to be able to provide an even more user-friendly method and a storage atmosphere which is, in particular, adapted in an improved manner to the storage item in a refrigeration compartment of the household refrigeration appliance, it is proposed that at least one state information of the storage item is detected in the detection step. The detection unit could detect the state information of the storage item in the detection step. Alternatively, the state information could also be stored in the database which is, in particular, predefined. The state information is preferably correlated with a state of the storage item, such as for example packaged, open, whole, halved, cut, diced and/or in slices, and potentially characterizes the storage item, in particular at least approximately and advantageously clearly. Alternatively and/or additionally, the state information could also be a state relative to a temperature and/or a degree of maturity of the storage item.

It is further proposed that the state information is taken into consideration when the acceptance storage atmosphere is determined. As a result, an acceptance storage atmosphere and/or target storage atmosphere can be advantageously determined more efficiently, in particular more accurately and/or more rapidly. In particular, the computing unit is provided to take into consideration the state information when the target storage atmosphere and/or the acceptance storage atmosphere are determined. As a function of the state information, only those acceptance and/or target parameters, such as for example the temperature and/or air humidity, which are important relative to the storage item in terms of the state information for the storage of the storage item, can be determined in the determination step. Potentially in the case of a packaged storage item being detected, for example, only the acceptance temperature and/or the target temperature could be determined during the determination of the acceptance storage atmosphere and a determination of the acceptance air humidity and/or target air humidity could be dispensed with.

The method according to the invention and the appliance according to the invention are not intended to be limited to the above-described use and embodiment. In particular, the method for operating the household refrigeration appliance can have a number of method steps deviating from a number cited herein in order to fulfill a mode of operation described herein. Moreover, the household refrigeration appliance according to the invention can have a number of individual elements, components and units deviating from a number cited herein in order to fulfill a mode of operation described herein.

Further advantages are found in the following description of the drawings. An exemplary embodiment of the invention is shown in the drawings. The drawings, the description and the claims contain numerous features in combination. The person skilled in the art will also expediently consider the features individually and combine them together to form further meaningful combinations.

DETAILED DESCRIPTION OF THE INVENTION

Figure 1:
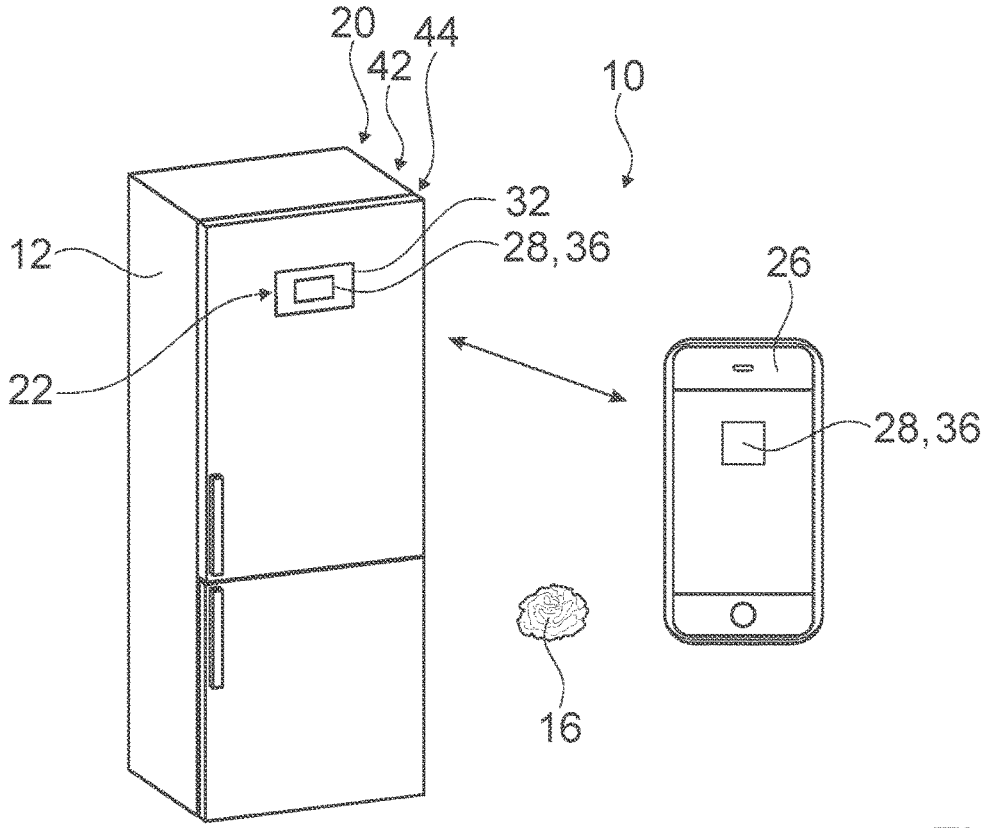
FIG. 1 shows an exemplary household system with a household refrigeration appliance and a mobile terminal device.

FIG. 1 shows an exemplary household system 10 which is provided for use in a household and which has a household refrigeration appliance 12. The household refrigeration appliance 12 is configured in the present case as a refrigerator. Alternatively and/or additionally, the household refrigeration appliance 12 could also be configured as a freezer, upright freezer, chest freezer and/or fridge-freezer.

Figure 2:
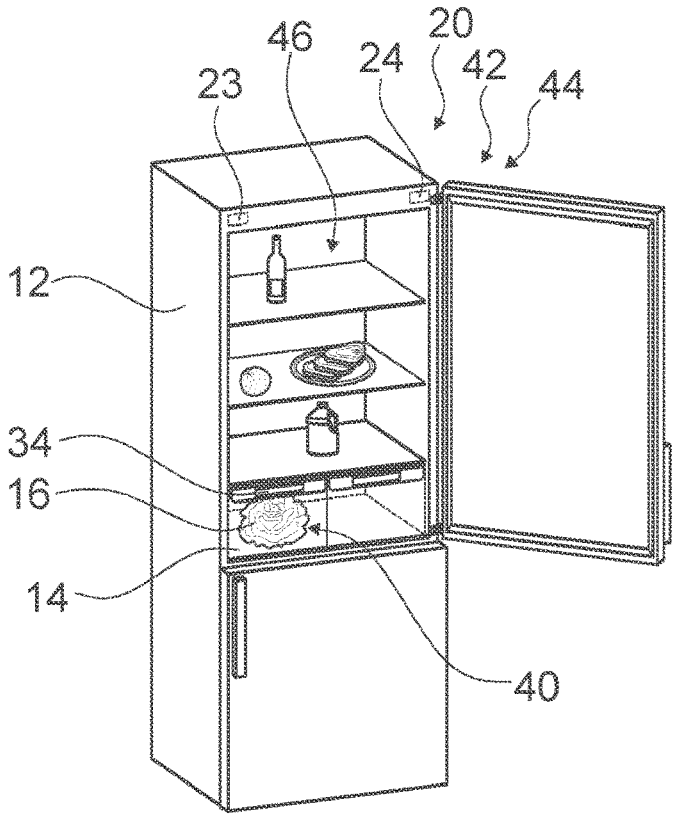
FIG. 2 shows an internal view of the household refrigeration appliance with at least one refrigeration compartment.
Figure 3:
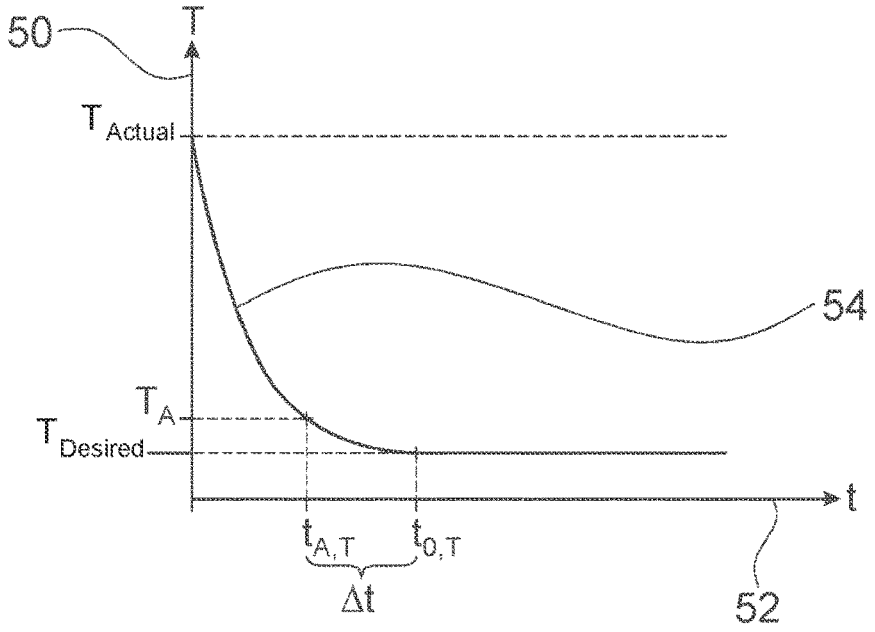
FIG. 3 shows a schematic graph of a temperature profile relative to a storage atmosphere in the refrigeration compartment.
Figure 4:
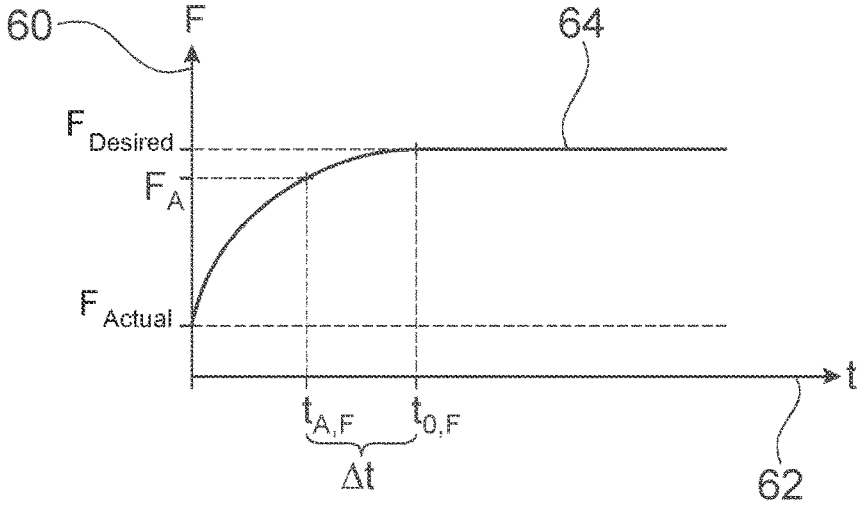
FIG. 4 shows a schematic graph of a relative air humidity profile relative to the storage atmosphere and FIG. 5 shows a schematically shown process flow diagram of a method for operating the household refrigeration appliance.
Figure 5:
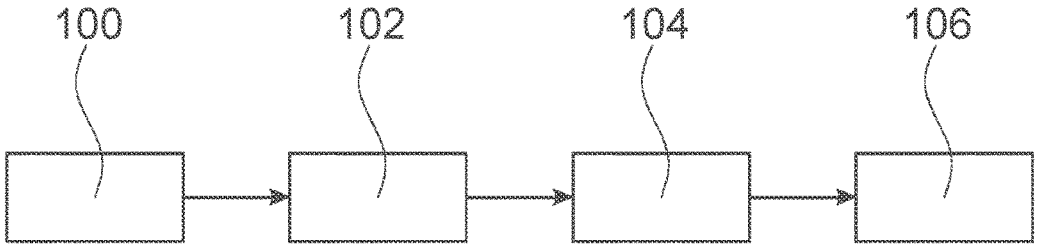

While FIGS. 1 and 2 show in each case at least one view of the household refrigeration appliance 12, for clarity, a schematically shown process flow diagram of a method for operating a household refrigeration appliance 12 is shown in FIG. 5. Before FIGS. 1 to 4 are discussed, it should be mentioned that the process flow diagram shown in FIG. 5 illustrates that the method has a plurality of method sub-steps. In this exemplary embodiment, a first method sub-step is denoted as the detection step 100 and relative to a time progression of the method takes place before a second method sub-step of the method denoted as the determination step 102. A third method sub-step which describes a verification step 104 follows the determination step 102, wherein a fourth method sub-step denoted as the adaptation step 106 follows the verification step 104.

For detecting at least one storage item 16 which is to be arranged and/or is arranged in a refrigeration compartment 14 of the household refrigeration appliance 12, the household refrigeration appliance 12 and/or household system 10 has a detection unit 20 which in the present case is integrated in the household refrigeration appliance 12. Additionally, the detection unit 20 could be provided for detecting an interior 46 of the household refrigeration appliance 12. As can be derived from FIG. 2, the household refrigeration appliance 12 has a plurality of refrigeration compartments in the interior 46 for storing storage items. In the present case only one refrigeration compartment 14 and one storage item 16, which is present by way of example as a lettuce, is provided with a reference sign. While in FIG. 1 the storage item 16 has not yet been introduced, in FIG. 2 the storage item 16 is located in the refrigeration compartment 14.

In the detection step 100, a storage item 16 which is to be arranged and/or is arranged in the refrigeration compartment 14 is detected by the detection unit 20. The detection unit 20 has at least one detection element 22, 23, 24 (see FIGS. 1 and 2). The detection element 22 is provided for detecting the storage item 16 which is to be arranged and which is still located outside the household refrigeration appliance 12, in a closed state of the household refrigeration appliance 12. The detection elements 23, 24 are provided for detecting the storage item 16 which is to be arranged and/or is arranged in the refrigeration compartment 14 and/or for detecting the interior 46. In the present case, the detection unit 20 and at least the detection element 22, 23, 24 has at least one image detection unit. The household refrigeration appliance 12 comprises a computing unit 44. In the present case, the computing unit 44 is integrated in the household refrigeration appliance 12, advantageously in a housing of the household refrigeration appliance 12. The computing unit 44 is provided for processing data. Moreover, the household refrigeration appliance 12 has a control unit 42 for controlling an operation of the household refrigeration appliance 12 according to the method described herein. In the present case, the computing unit 44 is operatively connected to the control unit 42.

A storage atmosphere of the refrigeration compartment 14 is defined on the basis of at least one parameter, potentially on the basis of a plurality of parameters, for example a temperature T and/or a relative air humidity F of the refrigeration compartment 14. In the present case, the method according to the invention is described by way of example on the basis of the temperature T and the relative air humidity F of the refrigeration compartment 14, wherein FIG. 3 shows a schematic graph of a temperature profile 54 and FIG. 4 shows a schematic graph of a relative air humidity profile 64 relative to the storage atmosphere plotted over time t (see FIGS. 3 and 4).

At least one piece of state information 40 of the storage item 16, such as for example packaged, open, whole, halved, cut, diced and/or in slices, is detected in the detection step 100. In the determination step 102 following the detection step 100, as a function of the determined storage item 16, a target storage atmosphere $T_{Target}$, $F_{Target}$ is determined for storing the storage item 16 in the refrigeration compartment 14. Additionally, an acceptance storage atmosphere $T_A$, $F_A$, which differs from a target storage atmosphere $T_{Target}$, $F_{Target}$ for storing the storage item 16 in the refrigeration compartment 14 and in which storage of the storage item 16 is still and/or already acceptable, is determined in the determination step 102 based on the storage item 16. The state information 40 is taken into consideration when the acceptance storage atmosphere $T_A$, $F_A$ is determined.

The verification step 104 following the determination step 102 is provided to verify an actual storage atmosphere $T_{Actual}$, $F_{Actual}$ in the refrigeration compartment 14, wherein the actual storage atmosphere $T_{Actual}$, $F_{Actual}$ is also compared with the determined acceptance storage atmosphere $T_A$, $F_A$ in the verification step 104. In the present case, the computing unit 44 is provided for determining the acceptance storage atmosphere $T_A$, $F_A$ and/or the target storage atmosphere $T_{Target}$, $F_{Target}$. Additionally, the computing unit 44 is provided for comparing the actual storage atmosphere $T_{Actual}$, $F_{Actual}$ with the acceptance storage atmosphere $T_A$, $F_A$. In the present embodiment, the detection unit 20 is provided for verifying the actual storage atmosphere $T_{actual}$, $F_{actual}$ in the refrigeration compartment 14.

If a deviation of the actual storage atmosphere $T_{actual}$, $F_{actual}$ from the determined acceptance storage atmosphere $T_A$, $F_A$ relative to the detected storage item 16 is identified in the verification step 104, the actual storage atmosphere $T_{actual}$, $F_{Actual}$ is changed in the direction of the acceptance storage atmosphere $T_A$, $F_A$ in the adaptation step 106. Additionally, in the present case if the actual storage atmosphere $T_{actual}$, $F_{actual}$ deviates from the target storage atmosphere $T_{Target}$, $F_{Target}$ the actual storage atmosphere $T_{Actual}$, $F_{actual}$ is changed to the target storage atmosphere $T_{Target}$, $F_{Target}$ in the adaptation step 106. FIGS. 3 and 4 show in each case the above-described temperature profile 54 and the relative air humidity profile 64, wherein in each case the x-axis represents a time axis 52, 62 and the y-axis represents a temperature axis 50 and a relative air humidity axis 60. It should be mentioned that in the adaptation step 106 the acceptance storage atmosphere $T_A$, $F_A$ is reached at an acceptance time $t_{A,T}$, $t_{A,F}$ along the time axis 52, 62. The target storage atmosphere $T_{Target}$, $F_{Target}$ is reached at a target time $t_{0,T}$, $t_{0,F}$, wherein the target time $t_{0,T}$, $t_{0,F}$, is located along the time axis 52, 62 after the acceptance time $t_{A,T}$, $t_{A,F}$. As a result, a time difference $\Delta t$ is defined between the acceptance time $t_{A,T}$, $t_{A,F}$ and the target time $t_{0,T}$, $t_{0,F}$. The acceptance storage atmosphere $T_A$, $F_A$ is thus reached at an earlier acceptance time $t_{A,T}$, $t_{A,F}$ in the adaptation step 106 so that a waiting time for the user until the storage atmosphere in the refrigeration compartment 14 is adapted to the target storage atmosphere $T_{Target}$, $F_{Target}$ can be shortened and the storage of the storage item 16 is still and/or already acceptable when the acceptance storage atmosphere $T_A$, $F_A$ is present.

In the present case, at least one output 28 is generated as a function of the detected storage item 16 relative to the acceptance storage atmosphere $T_A$, $F_A$ of the storage item 16. To this end, the household refrigeration appliance 12 has at least one output element 32, 34. In the present case, the output element 32 is integrated in the housing and the output element 34 is integrated in the refrigeration compartment 14 and connected so as to communicate with the computing unit 44 and/or the control unit 42. The output element 32, 34 displays the output 28. Moreover, in the present case the household system 10 has a mobile terminal device 26 which in this example is configured as a cell phone (see FIG. 1). The output 28 is generated on the mobile terminal device 26 advantageously at the same time as the output 28 is generated by means of the output element 32, 34. The output 28 comprises a status message 36 which is output in the adaptation step 106 relative to the acceptance storage atmosphere $T_A$, $F_A$ being reached. The status message 36 comprises a storage request which is output when the acceptance storage atmosphere $T_A$, $F_A$ is reached at the acceptance time $t_{A,T}$, $t_{A,F}$ and/or the target storage atmosphere $T_{Target}$, $F_{Target}$ is reached at the target time $t_{0,T}$, $t_{0,F}$, so that the user is prompted to store the storage item 16 (see FIGS. 1 and 2). Moreover, the output 28 comprises a warning message which is output in the adaptation step 106 relative to an absence of the acceptance storage atmosphere $T_A$, $F_A$ and namely before the acceptance time $t_{A,T}$, $t_{A,F}$. Thus the user is made aware of an absence of the acceptance storage atmosphere $T_A$, $F_A$ and potentially prompted not to store the storage item 16 yet. As a result, during the entire adaptation step 106 the output indicates to the user by means of the status message 36 a status of the storage atmosphere in the refrigeration compartment 14.

REFERENCE SIGNS

10 Household system
12 Household refrigeration appliance

14 Refrigeration compartment
16 Storage item
20 Detection unit
22 Detection element
23 Detection element
24 Detection element
26 Mobile terminal device
28 Output
32 Output element
34 Output element
36 Status message
40 State information
42 Control unit
44 Computing unit
46 Interior
50 Temperature axis
52 Time axis
54 Temperature profile
60 Air humidity axis
62 Time axis
64 Air humidity profile
100 Detection step
102 Determination step
104 Verification step
106 Adaptation step
T Temperature
F Relative air humidity
$T_{Target}$ Target temperature
$F_{Target}$ Target air humidity
$T_{Actual}$ Actual temperature
$F_{Actual}$ Actual air humidity
$T_A$ Acceptance temperature
$F_A$ Acceptance air humidity
Δt Time difference
$t_{A,T}$ Acceptance time
$T_A$,F Acceptance time
$t_{0,T}$ Target time
$t_{0,F}$ Target time

The invention claimed is:

1. A method for operating a household refrigeration appliance, which comprises the steps of:

detecting a storage item which is to be disposed and/or is disposed in a refrigeration compartment of the household refrigeration appliance in a detection step;

determining a target storage atmosphere for storing the detected storage item; and determining an acceptance storage atmosphere which differs from the target storage atmosphere for storing the storage item in the refrigeration compartment and in which storage of the storage item is acceptable based on the storage item.

2. The method according to claim 1, which further comprises verifying and comparing an actual storage atmosphere in the refrigeration compartment with the acceptance storage atmosphere determined in a verification step.

3. The method according to claim 2, wherein if the actual storage atmosphere deviates from the acceptance storage atmosphere, changing the actual storage atmosphere in a direction of the acceptance storage atmosphere in an adaptation step.

4. The method according to claim 3, wherein if the actual storage atmosphere deviates from the target storage atmosphere, changing the actual storage atmosphere to the target storage atmosphere in the adaptation step.

5. The method according to claim 3, which further comprises generating at least one output in dependence on the storage item detected relative to the acceptance storage atmosphere of the storage item.

6. The method according to claim 5, which further comprises generating the at least one output on a mobile terminal device.

7. The method according to claim 5, wherein the at least one output includes a status message which is output in the adaptation step relative to the acceptance storage atmosphere being reached.

8. The method according to claim 7, which further comprises forming the status message with a storage request.

9. The method according to claim 5, wherein the at least one output includes a warning message which is output in the adaptation step relative to an absence of the acceptance storage atmosphere.

10. A method for operating a household refrigeration appliance, which comprises the steps of:

detecting a storage item which is to be disposed and/or is disposed in a refrigeration compartment of the household refrigeration appliance in a detection step;

detecting at least one piece of state information of the storage item in the detection step;

determining a target storage atmosphere for storing the detected storage item; and determining an acceptance storage atmosphere which differs from the target storage atmosphere for storing the storage item in the refrigeration compartment and in which storage of the storage item is acceptable based on the storage item.

11. The method according to claim 10, which further comprises taking the at least one piece of state information into consideration when the acceptance storage atmosphere is determined.

12. A household refrigeration appliance, comprising:

at least one refrigeration compartment for storing a storage item; and a controller for carrying out the method according to claim 1.

13. A household system, comprising:

the household refrigeration appliance according to claim 12; and a mobile terminal device.

* * * * *